US007537334B2

(12) United States Patent
Yang et al.

(10) Patent No.: US 7,537,334 B2
(45) Date of Patent: May 26, 2009

(54) MEDIA LINEFEED ERROR COMPENSATION METHOD

(75) Inventors: Aiqiang Yang, Singapore (SG); Michael Nordlund, Singapore (SG); Manish Agarwal, Singapore (SG); Sing-Yan Wan, Singapore (SG); Ban-Ho Chong, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 447 days.

(21) Appl. No.: 11/231,136

(22) Filed: Sep. 20, 2005

(65) Prior Publication Data

US 2007/0064079 A1 Mar. 22, 2007

(51) Int. Cl.
*B41J 2/01* (2006.01)

(52) U.S. Cl. ..... 347/107; 347/104; 347/16; 347/5

(58) Field of Classification Search ..... 347/16, 347/104, 107
See application file for complete search history.

(56) References Cited

U.S. PATENT DOCUMENTS

| | | | | | |
|---|---|---|---|---|---|
| 5,674,019 | A * | 10/1997 | Munakata et al. | ..... | 400/568 |
| 6,126,345 | A * | 10/2000 | Ito et al. | ..... | 400/624 |
| 6,137,592 | A | 10/2000 | Arquilevich et al. | | |
| 6,158,344 | A * | 12/2000 | Walker et al. | ..... | 101/484 |
| 6,298,778 | B1 | 10/2001 | Onodera et al. | | |
| 6,345,170 | B1 | 2/2002 | Nakazato et al. | | |
| 6,454,474 | B1 * | 9/2002 | Lesniak et al. | ..... | 400/582 |
| 6,568,784 | B2 | 5/2003 | Izumi et al. | | |
| 6,582,052 | B2 | 6/2003 | Sarmast et al. | | |
| 7,189,018 | B2 * | 3/2007 | Cercos et al. | ..... | 400/578 |
| 2002/0063871 | A1 | 5/2002 | Kinas | | |
| 2002/0135629 | A1 | 9/2002 | Sarmast et al. | | |
| 2006/0158475 | A1 * | 7/2006 | Arquilevich et al. | ..... | 347/19 |

* cited by examiner

*Primary Examiner*—Matthew Luu
*Assistant Examiner*—Henok Legesse

(57) ABSTRACT

In a method for compensating for media linefeed errors in a media feed apparatus, a first correction parameter is applied during a first length of a media feed operation and a second correction parameter, which differs from the first correction parameter, is applied during a second length of the media feed operation.

7 Claims, 5 Drawing Sheets

MEDIA LINEFEED ERROR COMPENSATION METHOD

BACKGROUND

A conventional printer includes a carriage for holding a print cartridge containing ink. The carriage is typically scanned across the width of a media and ink is ejected from the print cartridge in a controlled manner to form a swath of an image during each scan. The height of the printed swath (as measured in the direction the media is advanced) is fixed for a particular printhead.

Between carriage scans, the media is advanced so that the next swath of the image may be printed. In most cases, the base of the just-printed swath must be precisely aligned with the top of the next-printed swath so that a continuous image may be printed on the media. Alternatively, the media may be advanced by less than a full swath height to effect a "shingling" type of printing. In any event, inaccurate media advances between carriage scans often result in print quality artifacts known as banding.

In an effort to prevent errors such as banding, conventional printers often employ techniques for determining offsets in the advancement of the media. Conventional printers also employ various correction techniques in an attempt to compensate for the offsets. The techniques employed by conventional printers, however, typically fail to adequately compensate for the offsets and are often difficult to implement.

SUMMARY OF THE INVENTION

A method for compensating for media linefeed errors in a media feed apparatus is disclosed herein. In the method, a first correction parameter is applied during a first length of a media feed operation and a second correction parameter, which differs from the first correction parameter, is applied during a second length of the media feed operation.

BRIEF DESCRIPTION OF THE DRAWINGS

Features of the present invention will become apparent to those skilled in the art from the following description with reference to the figures, in which.

DETAILED DESCRIPTION OF THE INVENTION

For simplicity and illustrative purposes, the present invention is described by referring mainly to an exemplary embodiment thereof. In the following description, numerous specific details are set forth in order to provide a thorough understanding of the present invention. It will be apparent however, to one of ordinary skill in the art, that the present invention may be practiced without limitation to these specific details. In other instances, well known methods and structures have not been described in detail so as not to unnecessarily obscure the present invention.

Disclosed herein is a linefeed calibration technique in which different correction parameters are implemented to compensate for errors commonly found during media feed operations, such as, for instance, during an image forming operation. More particularly, the different correction parameters are applied at different stages or zones of a media feed operation to more accurately compensate for the errors as compared with known error compensation techniques. Also disclosed herein is a technique for determining the correction parameters at the different stages or zones of a media feed operation.

Figure 1A:
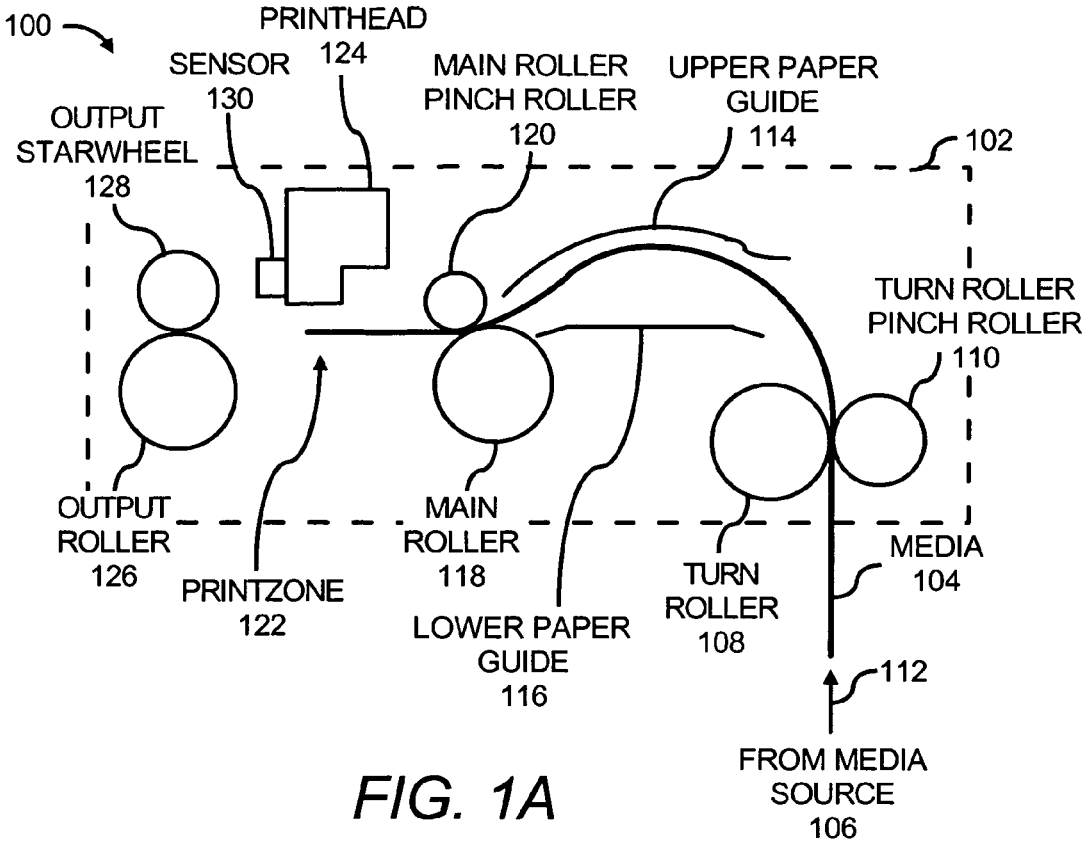
FIG. 1A shows a simplified schematic illustration of a media feed apparatus of an image forming apparatus, according to an embodiment of the invention.

With reference first to FIG. 1A, there is shown a simplified schematic illustration of part of an image forming apparatus 100 which may be employed to implement various examples of the invention. It should be readily apparent that the image forming apparatus 100 depicted in FIG. 1A represents a generalized illustration and that other components may be added or existing components may be removed or modified without departing from a scope of the image forming apparatus 100. For example, the image forming apparatus 100 may include any number of other components known to be included as a part of conventional image forming apparatuses.

Shown in FIG. 1A is a media feed apparatus 102 of the image forming apparatus 100. The media feed apparatus 102 may also include additional components and some of the components shown in the media feed apparatus 102 may be removed or modified without departing from a scope of the media feed apparatus 102. In addition, although the media feed apparatus 102 has been illustrated herein as forming part of an image forming apparatus 100, the media feed apparatus 102 may have separate utility outside of the image forming apparatus 100, without departing from a scope of the media feed apparatus. In any regard, FIG. 1A depicts a printable media 104, such as, paper, photopaper, vellum, or another type material, being fed from a media source 106. The media source 106 may include, for instance, a tray configured to support a plurality of media 104 sheets, a location for manually feeding of the media 104 sheets, etc.

The media 104 is depicted as entering into the media feed apparatus 102 through operation of a turn roller 108. More particularly, the media 104 is pinched between the turn roller 108 and a turn roller pinch roller 110. Rotation of the turn roller 108, in a counter-clockwise direction, generally causes the media 104 to be fed into the media feed apparatus 102 as indicated by the arrow 112. In addition, the media 104 is fed between an upper paper guide 114 and a lower paper guide 116 of the media feed apparatus 102.

A portion of the media 104 is also illustrated as being pinched between a main roller 118 and a main roller pinch roller 120. At this stage in the media 104 feed operation, the media 104 is fed through the media feed apparatus 102 according to the speeds at which the turn roller 108 and the main roller 118 are rotating. Oftentimes, the media 104 is bulged between the turn roller 108 and the main roller 118, which generally causes the media 104 to be fed at a relatively slower rate as compared to when the media 104 is fed solely by the turn roller 108. If the media 104 is fed solely by the main roller 118, the media 104 typically takes on a flatter shape and also moves at a relatively faster rate.

In instances where the media feed apparatus 102 forms part of an image forming apparatus 100, the media 104 may be fed through a printzone 122, where ink from one or more printheads (only a single printhead 124 is shown in FIG. 1A) may be applied onto the media 104. As is generally known with inkjet printers, the printheads 124 may include reservoirs containing ink of various colors, such as, cyan, magenta, yellow, black, etc., and nozzles through which the ink is ejected and deposited onto the media 104. In addition, the printheads 124 may be positioned on a movable carriage (not shown) configured to scan across the media 104, thereby enabling ink to be deposited across the width of the media 104. Alternatively, however, a sufficient number of printheads 124 may be provided across the width of the media 104 to enable sufficient ink coverage without requiring that the printheads 124 be scanned.

As described above, if there are errors in the feeding of the media 104, or linefeed errors, as the media 104 is fed through the printzone 122, the ink may be misplaced on the media 104, thereby causing errors. Linefeed errors of the media 104 may be created at a plurality of stages during feeding of the media 104. More particularly, linefeed errors may be created as the media 104 is advanced through the printzone 122 by the main roller 118. In addition, linefeed errors may be created as the media 104 passes through the printzone 122 and is fed by the output roller 126.

In this regard, both the main roller 118 and the output roller 126 are susceptible to linefeed errors that cause positioning inaccuracies of the media 104 across the printzone 122. Linefeed errors may be characterized in at least two ways, run-out error and diametrical error. Run-out error is due to undesired eccentric rotation of the main roller 118 or the output roller 126. Diametrical error is due to a change in the diameter of the main roller 118 or the output roller 126 itself. Both types of errors are typically caused by inaccuracies in the manufacture of the main roller 118 or output roller 126, and the result causes linefeed advance to be off by increments typically approximating less than 1/600 of an inch. In addition, the main roller 118 and the output roller 126 may have differing levels of either or both of the diametrical errors and the run-out errors.

As described in greater detail herein below, different correction parameters may be applied depending upon whether the media 104 is being fed through the printzone 122 by the main roller 118 or the output roller 126. In other words, linefeed calibration operations of the main roller 118 and the output roller 126 are performed in a multi-stage manner. In this regard, diametrical and run-out errors caused by both the main roller 118 and the output roller 126 may be compensated for with a relatively higher degree of precision as compared with conventional error correction techniques, which typically uses a single, averaged, correction value across the entire length of a sheet of media.

In addition, a third correction parameter may be applied to the main roller 118 for cases where there may be coincidental feeding of the media 104 by the main roller 118 and the turn roller 108. The turn roller 108 may also create linefeed errors as described above with respect to the main roller 118 due to turn roller 108 diametrical errors and run-out errors that may induce forces on to the media 104, which may combine with the drive forces of the main roller 118 applied to the media 104. The additional loading of the media 104 by the turn roller errors may affect the linefeed advance characteristics of the main roller 118. By way of example, the third correction parameter may be applied to the main roller 118 during the media advance through the printzone 122 when the media is driven coincidently by the main roller 118 and the turn roller 108. Once the media is released by the turn roller 108, a main roller 118 correction value may be applied, and the third correction value may no longer be applied to the main roller 118.

More particularly, for instance, the third correction parameter may be applied to compensate for forces applied to the media 104 in the media feed direction as demonstrated by the presence of any bulging in the media 104 that may be created as the media 104 is fed between the nips of the turn roller 108 and the main roller 118.

Figure 1B:
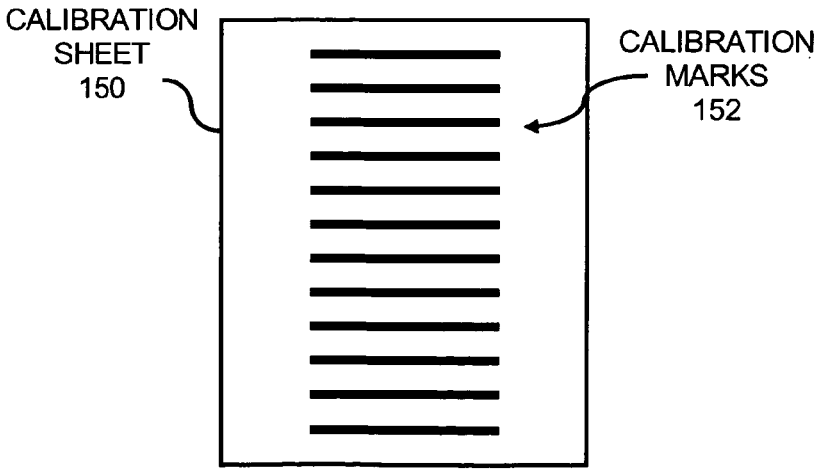
FIG. 1B shows a simplified illustration of a calibration sheet employable in the image forming apparatus depicted in FIG. 1A, according to an embodiment of the invention.

Also disclosed in greater detail herein below is a technique for determining the correction parameters. Generally speaking, however, a sensor 130 and a calibration sheet 150 (FIG. 1B) may be employed to calibrate the main roller 118 and the output roller 126. As shown in FIG. 1A, the sensor 130 may be positioned on or near the printhead 124 and may be configured to detect, for instance, images printed on the media 104. In this regard, for instance, the sensor 130 may be positioned downstream of the printhead 124 nozzles such that marks printed by the nozzles may subsequently be advanced passed the sensor 130, which may comprise an optical sensor mounted to the carriage (not shown). In addition, the sensor 130 may be configured to detect calibration marks 152 on the calibration sheet 150.

The calibration sheet 150 carries a number of calibration marks 152 and may be used in a way that substantially prevents the calibration media errors from affecting the calculation. The term "calibration media errors" generally means the errors or deviations between the measured, nominal locations of the calibration marks 152 and the actual locations of the calibration marks 152 on the calibration sheet 150 resulting from inaccuracies in the measurement of those calibration marks 152, which would otherwise introduce additional errors, and thus defeat the calibration process.

Although the calibration marks 152 are depicted as being relatively uniform throughout the calibration sheet 150, the calibration marks 152 may comprise differently configured calibration marks 152 for calibration of different components in the media feed apparatus 102 without departing from a scope thereof. For instance, some of the calibration marks 152 may be employed to calibrate the coincidental feed of the calibration sheet 150 by the turn roller 108 and the main roller 118, some of the calibration marks 152 may be employed to calibrate the main roller 118, and some of the other calibration marks 152 may be employed to calibrate the output roller 126.

Figure 2:
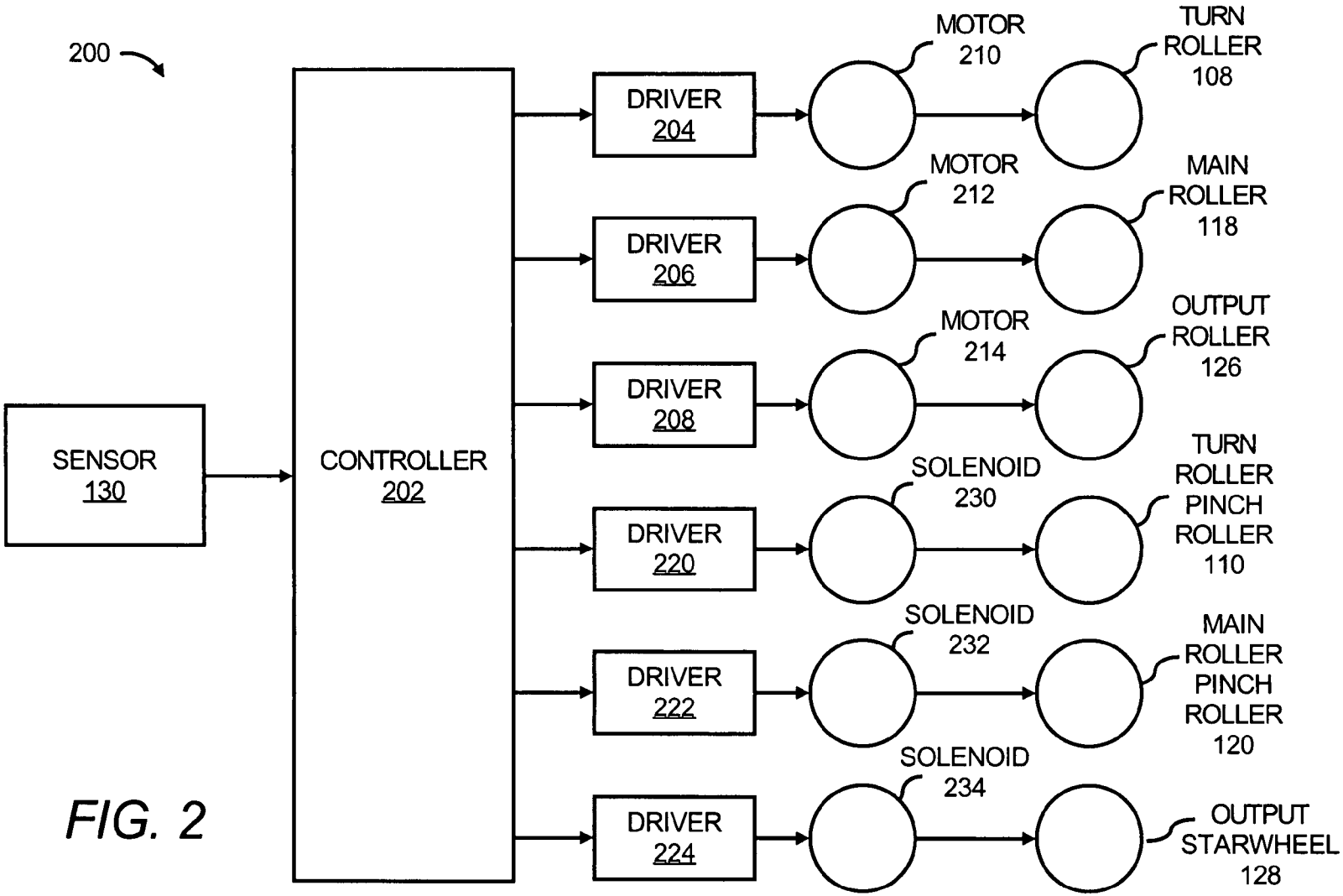
FIG. 2 is a block diagram of a control system for controlling components of a media feed apparatus, according to an embodiment of the invention.

FIG. 2 is a block diagram of a control system 200 for controlling components of a media feed apparatus. It should be understood that the following description of the control system 200 is but one manner of a variety of different manners in which such a control system 200 may be configured. In addition, it should be understood that the control system 200 may include additional components and that some of the components described herein may be removed and/or modified without departing from a scope of the control system 200.

Generally speaking, the control system 200 may be implemented to at least control one or more operations of the media feed apparatus 102. More particularly, for instance, the control system 200 may control the components of the media feed apparatus 102 such that different correction parameters are applied at different stages of a media feed operation. In addition, the control system 200 may control the components of the media feed apparatus 102 to determine the different correction parameters. Although not shown, the control system 200 may also control the printheads 124 as well as the carriage (not shown) to perform image forming operations on the media 104. These functions, however, may be performed by a different control system without departing from a scope of the control system 200.

As shown in FIG. 2, the control system 200 includes a controller 202 configured to perform various operations with regard to one or more of the components in the media feed apparatus 102. In this regard, the controller 202 may comprise a controlling means, such as, a microprocessor, a microcontroller, an application specific integrated circuit (ASIC), and the like, configured to perform various evaluation and control operations described herein.

The controller 202 is configured to send operating signals to motor drivers 204-208 to drive motors 210-214 respectively connected to the turn roller 108, the main roller 118, and the output roller 126. The drive motors 210-214 may also be respectively connected to one or more of the turn roller pinch roller 110, the main roller pinch roller 120, and the output starwheel 128 without departing from a scope of the control system 200. Generally speaking, the motor drivers 204-208 drive the motors 210-214 that turn the respective rollers 108, 118, 126. The controller 202 is also configured to send operating signals to solenoid drivers 220-224 to drive solenoids 230-234 that selectively move the turn roller pinch roller 110, the main roller pinch roller 120, and the output starwheel 128 into or out of contact with respective ones of the turn roller 108, the main roller 118, and the output roller 126.

The controller 202 is therefore operable to control rotation of the turn roller 108, the main roller 118, and the output roller 126, such that different correction parameters may be applied to a plurality of the rollers 108, 118, and 126. In addition, the controller 202 may be operable to selectively control the engagement and disengagement of the main roller pinch roller 120 and the output starwheel 128 during, for instance, a calibration operation. In certain examples, the controller 202 may also be operable to selectively control the engagement and disengagement of the turn roller pinch roller 110. During the calibration operation, as well as during other stages of an image forming operation, the controller 202 may receive signals from the sensor 130. Some of the controller 202 operations are described in greater detail herein below with respect to the following flow diagrams.

Figure 3:
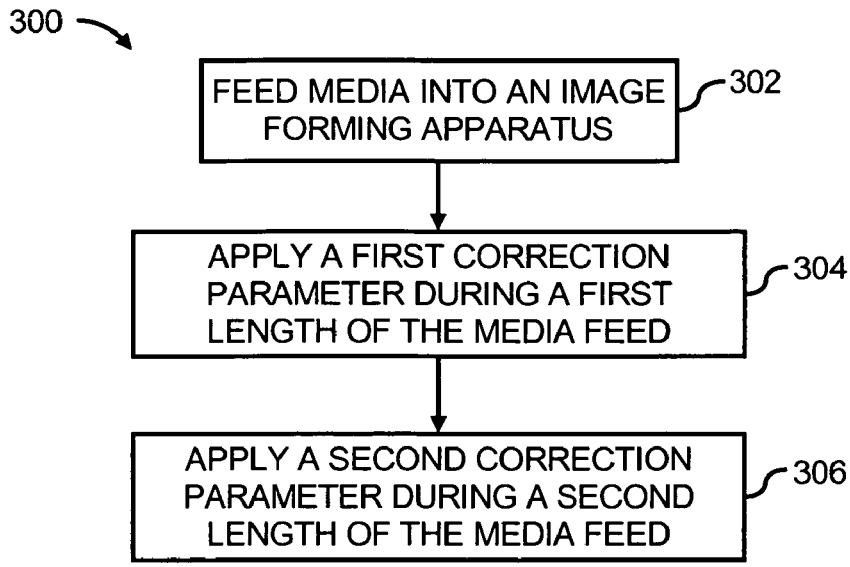
FIG. 3 illustrates a flow diagram of a method for compensating media linefeed errors, according to an embodiment of the invention.

FIG. 3 illustrates a flow diagram of a method 300 for compensating media linefeed errors, according to an example. It should be understood that the following description of the method 300 is but one manner of a variety of different manners in which an example of the invention may be practiced. It should also be apparent to those of ordinary skill in the art that the method 300 represents a generalized illustration and that other steps may be added or existing steps may be removed, modified or rearranged without departing from a scope of the method 300.

The description of the method 300 is made with reference to FIGS. 1A and 2, and thus makes reference to the elements cited therein. It should, however, be understood that the method 300 is not limited to the elements set forth in FIGS. 1A and 2. Instead, it should be understood that the method 300 may be practiced by an image forming apparatus and control system having different configurations than those set forth in FIGS. 1A and 2.

At step 302, a sheet of media 104 is fed into a media feed apparatus 102. The media 104 may be fed, for instance, into the media feed apparatus 102 at a first speed. In addition, the media 104 may be fed into the media feed apparatus 102 through the turn roller 108 and the turn roller pinch roller 110.

As the media 104 is fed through the media feed apparatus 102, a first correction parameter may be applied to the media 104 during a first length of the media feed, as indicated at step 304. The first correction parameter may be applied to the media 104 by one or both of the turn roller 108 and the main roller 118 to correct for errors associated with rotation of the either or both of the turn roller 108 and the main roller 118. Thus, for instance, the controller 202 may apply the first correction parameter by varying the media advance through the printzone 122 for which one or both of the turn roller 108 and the main roller 118 are rotated to feed the media 104 during the first length of the media feed.

As the media 104 is further fed through the media feed apparatus 102, a second correction parameter may be applied to the media 104 during a second length of the media feed, as indicated at step 306. The second correction parameter may be applied to the media 104 by one or both of the main roller 118 and the output roller 126 to correct for errors associated with rotation of either or both of the main roller 118 and the output roller 126. Thus, for instance, the controller 202 may apply the second correction parameter by varying the media advance through the printzone 122 for which one or both of the main roller 118 and the output roller 126 are rotated during a second length of the media feed operation.

The method 300 may include the application of one or more additional correction parameters. For instance, a third correction parameter may be during a third length of the media feed operation. The third correction parameter may be applied by the controller 202 on one of the rollers 108, 118, and 126 upon which neither of the first nor second correction parameters have been applied. In this regard, for instance, at least three different correction parameters may be applied during a media feed operation to compensate for linefeed errors that may occur during different stages of the media feed operation.

Figure 4B:
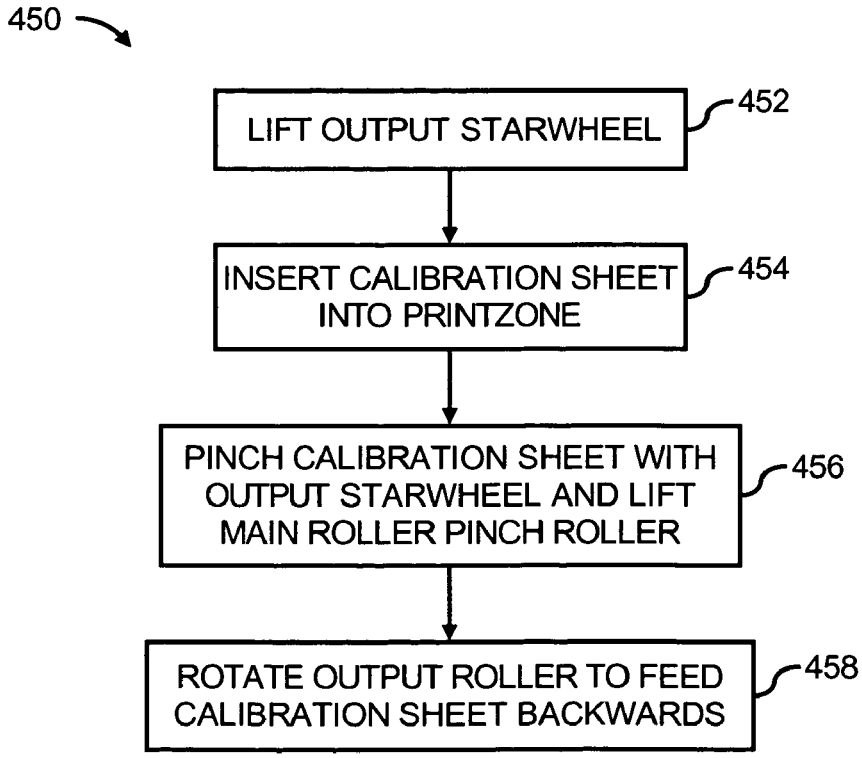
FIG. 4B illustrates a flow diagram of a method for inserting a calibration sheet into a media feed apparatus, according to an embodiment of the invention.
Figure 4A:
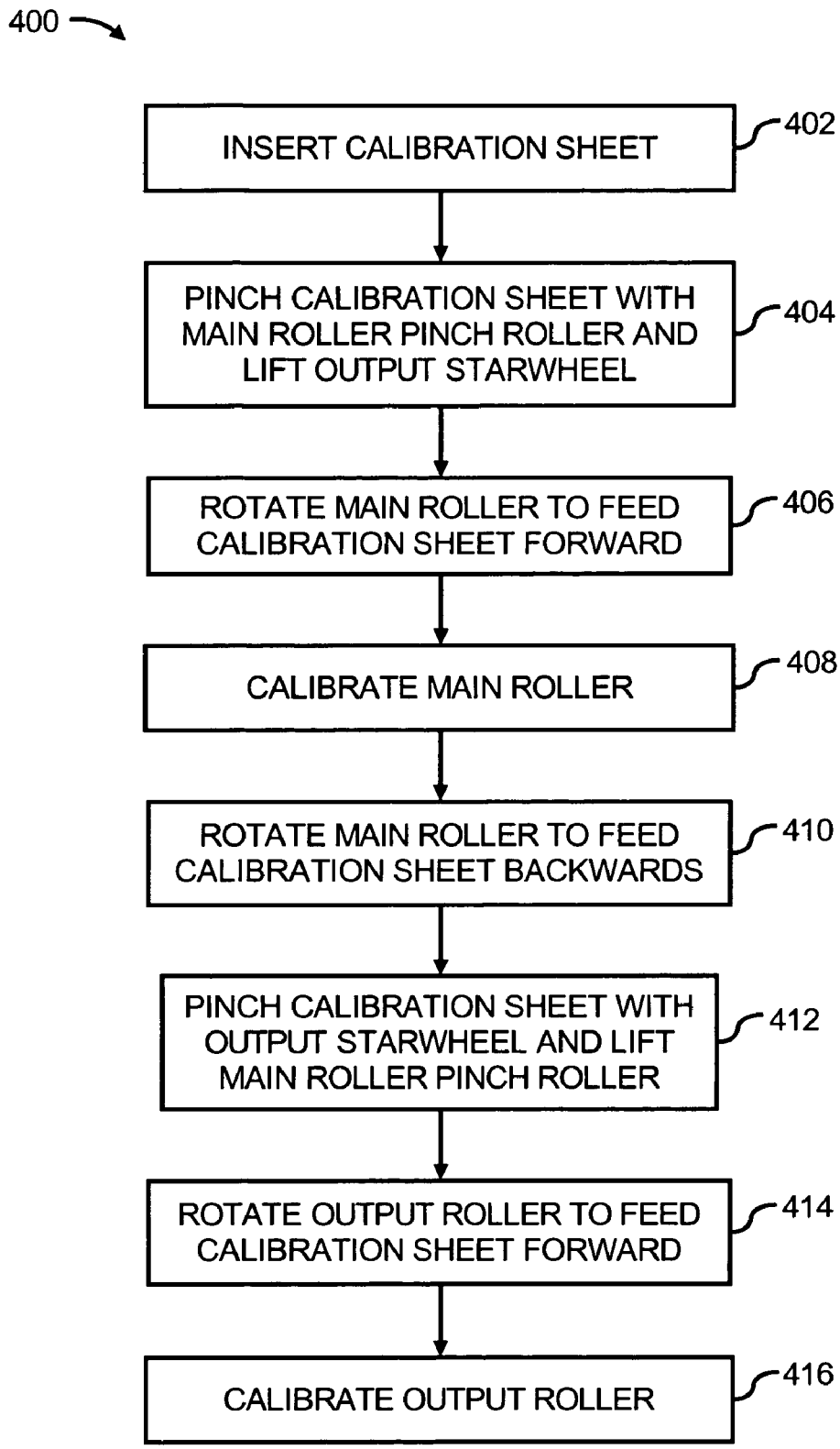
FIG. 4A illustrates a flow diagram of a method for calibrating a media feed apparatus, according to an embodiment of the invention.

With particular reference now to FIG. 4A, there is shown a flow diagram of a method 400 for calibrating a media feed apparatus, according to an example. It is to be understood that the following description of the method 400 is but one manner of a variety of different manners in which an example of the invention may be practiced. It should also be apparent to those of ordinary skill in the art that the method 400 represents a generalized illustration and that other steps may be added or existing steps may be removed, modified or rearranged without departing from a scope of the method 400.

The description of the method 400 is made with reference to FIGS. 1A and 2, and thus makes reference to the elements cited therein. It should, however, be understood that the method 400 is not limited to the elements set forth in FIGS. 1A and 2. Instead, it should be understood that the method 400 may be practiced by a media feed apparatus and control system having different configurations than those set forth in FIGS. 1A and 2.

At step 402, a calibration sheet 150 is inserted into the media feed apparatus 102. The calibration sheet 150 may be inserted as shown in FIG. 1A, in which case, the media 104 comprises the calibration sheet 150. Alternatively, however, the calibration sheet 150 may be inserted into the media feed apparatus 102 as described below with respect to the flow diagram shown in FIG. 4B and described herein below.

At step 404, the calibration sheet 150 may be pinched between the main roller 118 and the main roller pinch roller 120, and the output starwheel 128 may be lifted. One manner of a variety of different manners of lifting the output starwheel 128 may be through the activation of a solenoid driver 224 from FIG. 2 which turns a cam (not shown) to act upon a movable starwheel plate (not shown). In any regard, the output starwheel 128 may be disengaged from the output roller 128 and the output roller 128 therefore does not affect feeding of the calibration sheet 150.

At step 406, the main roller 118 may be rotated in a forward direction to cause the calibration sheet 150 to be fed toward the output roller 126 (FIG. 1A). As the calibration sheet 150 is fed, the main roller 118 may be calibrated, as indicated at step 408. The calibration process of step 408 may include a determination of run-out and diametrical errors associated with the main roller 118. The main roller 118 may be calibrated through detection of the calibration marks 152 by the sensor 130, as the calibration sheet 150 travels past the sensor 130. In addition, the main roller 118 may be calibrated in any reasonably suitable manner, for instance, in the manner described in commonly assigned U.S. Pat. No. 6,158,344 to Walker et al., entitled "Linefeed Calibration Using an Integrated Optical Sensor", and U.S. Pat. No. 6,454,474 to Lesniak et al., entitled "Calibration of a Media Advance System", the disclosures of which are hereby incorporated by reference in their entireties.

Calibration of the main roller 118 may include a determination of a first correction parameter to be applied when a sheet of media 104 is fed through the media feed apparatus 102. In this regard, for instance, the media advance distances of which the main roller 118 advances the media 104 through the printzone 122 may be varied according to the first correction parameter to thereby compensate for errors detected during the calibration step 408.

Following calibration of the main roller 118 at step 408, the main roller 118 may be rotated in a backward direction to cause the calibration sheet 150 to be fed away from the output roller 126 (FIG. 1A), as indicated at step 410. After the calibration sheet 150 has been fed a predetermined distance in the backward direction, the calibration sheet 150 may be pinched between the output roller 126 and the output starwheel 128, and the main roller pinch roller 120 may be lifted, as indicated at step 412. One manner of a variety of different manners of lifting the main roller pinch roller 120 may be through the activation of a solenoid driver 222 from FIG. 2, which turns a cam rod (not shown), which has an integrated spring tension cam (not shown) and a pinch plate cam (not shown) to engage and rotate a pinch plate (not shown) in order to move the main roller pinch roller 120 away from the main roller 118.

The predetermined distance in a backward direction may comprise a distance that enables the calibration sheet 150 to be pinched between the output roller 126 and the output starwheel 128. In addition, the main roller pinch roller 120 may be lifted such that the main roller pinch roller 120 may be disengaged from the main roller 118 and that the main roller 118 therefore does not affect feeding of the calibration sheet 150.

At step 414, the output roller 126 may be rotated in a forward direction to cause the calibration sheet 150 to be fed in a direction away from the main roller 118 (FIG. 1A). As the calibration sheet 150 is fed, the output roller 126 may be calibrated, as indicated at step 416. The calibration process of step 416 may include a determination of run-out and diametrical errors associated with the output roller 126. The output roller 126 may be calibrated through detection of the calibration marks 152 by the sensor 130, as the calibration sheet 150 travels by the sensor 130. The output roller 126 may be calibrated in any reasonably suitable manner, for instance, in the manner described in U.S. Pat. No. 6,158,344 and U.S. Pat. No. 6,454,474.

Calibration of the output roller 126 may include a determination of a second correction parameter to be applied when a sheet of media 104 is fed through the media feed apparatus 102. In this regard, for instance, the media advance distances of which the output roller 126 advances the media 104 through the printzone 122 may be varied according to the second correction parameter to thereby compensate for errors detected during the calibration step 416. As such, as the media 104 is advanced through the media feed apparatus 102, different correction levels may be applied to vary the distances at which the media is advanced and to thereby substantially prevent printing artifacts, such as, banding. A more detailed description of the application of the different correction parameters is set forth above with respect to the method 300 of FIG. 3.

Although not specifically illustrated in FIG. 4A, the method 400 may also include steps for calibrating the effects of the turn roller 108 during coincident feeding of the media 104 with the main roller 118. The influence of the turn roller 108 may be calibrated through use of a calibration sheet, similar to the calibration sheet 150. Generally speaking, the turn roller 108 may be calibrated by detecting the advancement of the calibration sheet past the sensor 130 and through the printzone 122 as the calibration sheet is fed coincidently by the turn roller 108 and the main roller 118. Once the calibration sheet 150 is released from the turn roller 108, the calibration of the effects of the turn roller 108 will cease. The controller 202 may be triggered by exemplary means when the calibration sheet 150 is released from the turn roller 108. One manner of a variety of different manners of implementing this function may involve a media presence sensor at the location of the turn roller 108.

A third correction parameter may be determined through calibration of the turn roller 108. In addition, the third correction parameter may be applied during a media feed operation to correct for errors caused by rotation of the turn roller 108.

As shown, the method 400 may be implemented to calibrate the media feed apparatus 102 during a single pick-eject cycle. That is, for instance, the calibration process of method 400 may be performed without requiring that a user manually calibrate the main roller 118 and the output roller 126 during separate calibration processes. Instead, the method 400 may be performed to calibrate the turn roller 108, the main roller 118, and the output roller 126 through a single user intervention event, which may include the insertion of the calibration sheet 150 into the media feed apparatus 102.

A method 450 in which the calibration sheet 150 may be inserted into the media feed apparatus 102 is depicted in FIG. 4B. It is to be understood that the following description of the method 450 is but one manner of a variety of different manners in which an example of the invention may be practiced. It should also be apparent to those of ordinary skill in the art that the method 450 represents a generalized illustration and that other steps may be added or existing steps may be removed, modified or rearranged without departing from a scope of the method 450.

The method 450 generally includes steps for the insertion of a calibration sheet 150 into a media feed apparatus 102 having a front loading capability and may be performed as step 402 in the method 400. At step 452, the output starwheel 128 may be lifted. The calibration sheet 150 may be inserted between the output starwheel 128 and the output roller 126, such that a trailing edge of the calibration sheet 150 is inserted into the printzone 122, as indicated at step 454. The output starwheel 128 may be lowered toward the output roller 126 and the main roller pinch roller 120 may be lifted to thereby pinch the calibration sheet 150 solely between the output roller 126 and the output starwheel 128, as indicated at step 456. At step 458, the output roller 126 may be rotated backwards to feed the calibration sheet 150 toward the main roller 118.

Following step 458, the steps outlined in the method 400 may be performed to calibrate the various components of the media feed apparatus 102.

Some or all of the operations set forth in the methods 300, 400, and 450 may be contained as a utility, program, or subprogram, in any desired computer accessible medium. In addition, some or all of the steps in the methods 300, 400, and 450 may be embodied by a computer program, which can exist in a variety of forms both active and inactive. For example, it can exist as software program(s) comprised of program instructions in source code, object code, executable code or other formats. Any of the above can be embodied on a computer readable medium, which include storage devices and signals, in compressed or uncompressed form.

Exemplary computer readable storage devices include conventional computer system RAM, ROM, EPROM, EEPROM, and magnetic or optical disks or tapes. Exemplary computer readable signals, whether modulated using a carrier or not, are signals that a computer system hosting or running the computer program can be configured to access, including signals downloaded through the Internet or other networks. Concrete examples of the foregoing include distribution of the programs on a CD ROM or via Internet download. In a sense, the Internet itself, as an abstract entity, is a computer readable medium. The same is true of computer networks in general. It is therefore to be understood that any electronic device capable of executing the above-described functions may perform those functions enumerated above.

Figure 5:
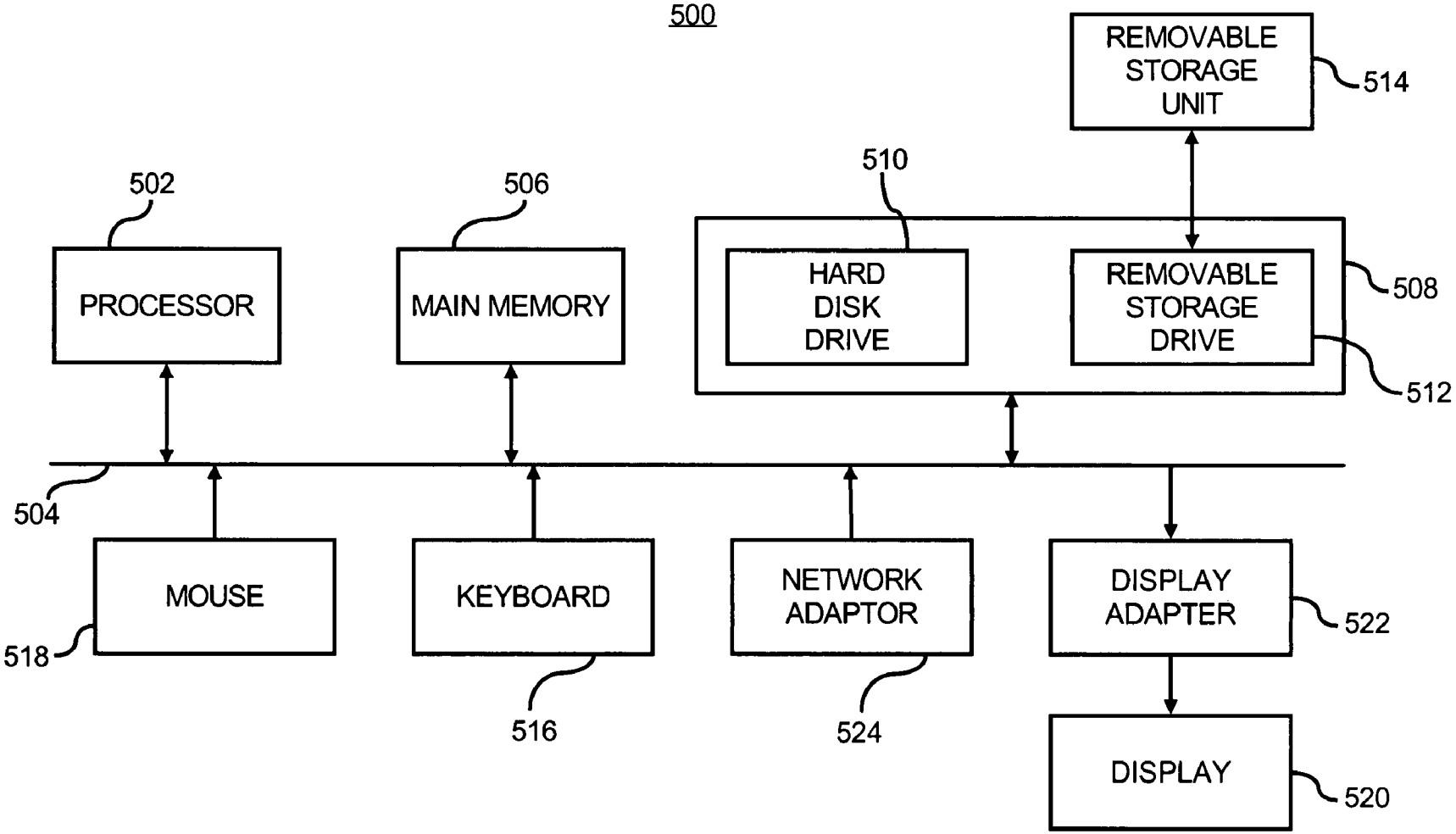
FIG. 5 illustrates a computer system, which may be employed to perform the various functions of the control system disclosed herein, according to an embodiment of the invention.

FIG. 5 illustrates a computer system 500, which may be employed to perform the various functions of the controller 202 described hereinabove, according to an embodiment. In this respect, the computer system 500 may be used as a platform for executing one or more of the functions described hereinabove with respect to the controller 202.

The computer system 500 includes one or more controllers, such as a processor 502. The processor 502 may be used to execute some or all of the steps described in the methods 300, 400, and 450. Commands and data from the processor 502 are communicated over a communication bus 504. The computer system 500 also includes a main memory 506, such as a random access memory (RAM), where the program code for, for instance, the controller 202, may be executed during runtime, and a secondary memory 508. The secondary memory 508 includes, for example, one or more hard disk drives 510 and/or a removable storage drive 512, representing a floppy diskette drive, a magnetic tape drive, a compact disk drive, etc., where a copy of the program code for the control system 200 may be stored.

The removable storage drive 510 reads from and/or writes to a removable storage unit 514 in a well-known manner. User input and output devices may include a keyboard 516, a mouse 518, and a display 520. A display adaptor 522 may interface with the communication bus 504 and the display 520 and may receive display data from the processor 502 and convert the display data into display commands for the display 520. In addition, the processor 502 may communicate over a network, for instance, the Internet, LAN, etc., through a network adaptor 524.

It will be apparent to one of ordinary skill in the art that other known electronic components may be added or substituted in the computer system 500. In addition, the computer system 500 may include a system board or blade used in a rack in a data center, a conventional "white box" server or computing device, etc. Also, one or more of the components in FIG. 5 may be optional (for instance, user input devices, secondary memory, etc.).

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims—and their equivalents—in which all terms are meant in their broadest reasonable sense unless otherwise indicated.

What is claimed is:

1. A method for compensating for media linefeed errors in a media feed apparatus having a main roller and an output roller, said method comprising:

determining a first correction parameter for the main roller by, inserting a calibration sheet into the media feed apparatus;

pinching the calibration sheet between the main roller and a main roller pinch roller;

lifting an output starwheel to substantially prevent the output roller from affecting movement of the calibration sheet; and calibrating the main roller;

determining a second correction parameter for the output roller;

feeding a media through the media feed apparatus;

applying the first correction parameter during a first length of the media feed; and applying the second correction parameter during a second length of the media feed, wherein the first correction parameter differs from the second correction parameter.

2. The method according to claim 1, further comprising:

applying a third correction parameter during a third length of the media feed, wherein the third correction parameter differs from at least one of the first correction parameter and the second correction parameter.

3. The method according to claim 1, wherein determining the first correction parameter for the main roller and the second correction parameter for the output roller further comprises employing a calibration sheet and a sensor in the media feed apparatus.

4. The method according to claim 3, wherein the calibration sheet includes calibration marks.

5. The method according to claim 4, wherein calibrating the main roller further comprises:

rotating the main roller to feed the calibration sheet in a forward direction toward the output roller;

detecting the calibration marks on the calibration sheet with the sensor as the calibration sheet is fed toward the output roller; and processing the detected positions of the calibration marks to calibrate the main roller.

6. The method according to claim 5, wherein determining the second correction parameter for the output roller further comprises:

rotating the main roller in a backward direction to feed the calibration sheet away from the output roller;

pinching the calibration sheet between the main roller and an output starwheel;

lifting the main roller pinch roller to substantially prevent the main roller from affecting movement of the calibration sheet; and calibrating the output roller.

7. The method according to claim 6, wherein calibrating the output roller further comprises:

rotating the output roller to feed the calibration sheet in the forward direction;

detecting the calibration marks on the calibration sheet with the sensor as the calibration sheet is fed in the forward direction; and processing the detected positions of the calibration marks to calibrate the output roller.

* * * * *